US010630026B2

(12) United States Patent
Suzuki et al.

(10) Patent No.: US 10,630,026 B2
(45) Date of Patent: Apr. 21, 2020

(54) MOVABLE CONNECTOR

(71) Applicant: IRISO ELECTRONICS CO., LTD., Kanagawa (JP)

(72) Inventors: Hitoshi Suzuki, Kanagawa (JP); Hiroaki Kobayashi, Kanagawa (JP); Yoshiyuki Ogura, Kanagawa (JP); Tomomitsu Saito, Kanagawa (JP); Daichi Shimba, Kanagawa (JP)

(73) Assignee: IRISON ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 16/414,172

(22) Filed: May 16, 2019

(65) Prior Publication Data

US 2019/0363491 A1 Nov. 28, 2019

(30) Foreign Application Priority Data

May 23, 2018 (JP) ..... 2018-099161

(51) Int. Cl.

| | |
|---|---|
| ***H01R 13/631*** | (2006.01) |
| ***H01R 12/70*** | (2011.01) |
| ***H01R 12/91*** | (2011.01) |
| ***H01R 12/71*** | (2011.01) |
| ***H01R 13/405*** | (2006.01) |
| ***H01R 13/502*** | (2006.01) |
| ***H01R 12/57*** | (2011.01) |
| ***H01R 13/187*** | (2006.01) |

(52) U.S. Cl.

CPC ..... *H01R 13/6315* (2013.01); *H01R 12/57* (2013.01); *H01R 12/707* (2013.01); *H01R 12/716* (2013.01); *H01R 12/91* (2013.01); *H01R 13/187* (2013.01); *H01R 13/405* (2013.01); *H01R 13/502* (2013.01)

(58) Field of Classification Search

CPC ..... H01R 13/6315; H01R 13/187; H01R 13/405; H01R 13/502; H01R 12/9157; H01R 12/707; H01R 12/716

USPC ..... 439/247

See application file for complete search history.

(56) References Cited

U.S. PATENT DOCUMENTS 3,808,589 A * 4/1974 Bonhomme ..... H01R 12/721 439/747
6,315,591 B2 * 11/2001 Oda ..... H01R 13/18 439/246
6,347,950 B1 * 2/2002 Yokoyama ..... H01R 13/6315 439/248

(Continued)

FOREIGN PATENT DOCUMENTS

JP 2017-139101 A 8/2017

*Primary Examiner* — Harshad C Patel

(74) *Attorney, Agent, or Firm* — Cermak Nakajima & McGowan LLP; Tomoko Nakajima

(57) ABSTRACT

There is provided a movable connector that facilitates easy engagement and improves stability in electrical connection. The movable connector includes a manipulation housing that is coupled to a movable housing by a pressing operation of the manipulation housing against the movable housing. The movable connector also includes a contact reinforcing member that moves together with the manipulation housing by the pressing operation. The contact reinforcing member comes into contact with a pair of contact portions of a circuit-board connection terminal and thereby presses the contact portions against a pin terminal.

4 Claims, 11 Drawing Sheets

(56) References Cited

U.S. PATENT DOCUMENTS

| | | | | |
|---|---|---|---|---|
| 6,755,691 | B2 * | 6/2004 | Sasame | H01R 12/7029 439/607.27 |
| 9,022,801 | B2 * | 5/2015 | Endo | H01R 13/533 439/527 |
| 9,799,971 | B2 * | 10/2017 | Ninomiya | H01R 12/52 |
| 9,997,854 | B2 * | 6/2018 | Kobayashi | H01R 12/91 |
| 2016/0118735 | A1 * | 4/2016 | Hoyack | H01R 24/542 439/247 |
| 2017/0222346 | A1 | 8/2017 | Kobayashi et al. | |

* cited by examiner

MOVABLE CONNECTOR

BACKGROUND OF THE INVENTION

1. Field of the Invention

The present invention relates to a connector having a floating function.

2. Description of the Related Art

An example of a known connector that electrically connects a connection object to the circuit of a circuit board is a bottom-entry type connector disclosed in Japanese Unexamined Patent Application Publication No. 2017-139101. The bottom-entry type connector or the connector 10 includes a fixed housing 11 to be mounted on a circuit board, a movable housing 12 to be accommodated in the fixed housing 11, and a terminal 13 having a movable member 13*b* that displaceably supports the movable housing 12 inside the fixed housing 11. In the movable housing 12, an insertion hole 12*e* is provided on a surface thereof that opposes the circuit board. In order to electrically connect a connection object (for example, a pin terminal or the like of an electrical element) to the connector 10, the connection object is inserted into the insertion hole 12*e* from the back side of the circuit board and brought into electrical contact with a contact portion 13*e* of the terminal 13 within the movable housing 12.

The known connector 10 may require an excessively high insertion force for the engagement of the connection object in a case that the number of connectors 10 mounted on the circuit board is large or each connector 10 includes many terminals 13. In this case, a user tends to mistakingly think that the engagement is completed when the user feels the insertion force becomes high. As a result, the user may stop inserting the connection object halfway, or performance in engagement operation may deteriorate. One solution to this is to decrease the contact pressure of the contact portion 13*e* against the connection object. However, decreasing the contact pressure may cause the contact portion 13*e* to be in fretting contact with the connection object, for example, under the service conditions in which the connector 10 is subjected to vibrations. As a result, plating on the surface of the connection object may be abraded due to fretting wear, which makes it difficult to maintain a stable electrical contact. In a movable connector such as the connector 10 of the bottom-entry type, the ease of multi-electrode connection and the stability of electrical connection of each contact portion are contradictory requirements.

SUMMARY OF THE INVENTION

The present invention is made with the above known art as background. An object of the invention is to provide a movable connector that can improve the ease of engagement and the stability of an electrical connection.

To achieve the above object, the present invention provides the movable connector as described below.

The movable connector includes a fixed housing to be fixed to a circuit board, a movable housing into which a connection object is inserted, and a circuit-board connection terminal. The circuit-board connection terminal has a circuit-board connection portion to be electrically connected to the circuit board, a support spring portion that displaceably supports the movable housing relative to the fixed housing, and a contact portion that comes into electrical contact with the connection object. The movable connector further includes a manipulation housing to be coupled to the movable housing by an operation of moving the manipulation housing relative to the movable housing. The manipulation housing has a contact reinforcing portion that presses the contact portion against the connection object as a result of the operation of moving the manipulation housing.

The manipulation housing is coupled to the movable housing by an operation of moving the manipulation housing relative to the movable housing. The contact reinforcing portion of the manipulation housing thereby presses the contact portion of the circuit-board connection terminal against the connection object. Due to the contact reinforcing portion pressing the contact portion, the contact portion comes into electrical contact with the connection object with a large contact pressure. According to the above configuration, a simple operation of moving the manipulation housing relative to the movable housing can cause the contact portion to come into firm electrical contact with the connection object.

The engagement and electrical connection between the movable connector and the connection object are not completed until the manipulation housing is operated. In the non-engagement state, the connection object inserted in the movable housing may be or may not be in contact with the contact portion. In other words, the movable connector can be formed so as to have a zero insertion force structure (ZIF structure) or a low insertion force structure (LIF structure). The connection object can be placed in the movable housing by applying a zero insertion force or a low insertion force, and thus the movable connector can improve the performance of the engagement operation. After the connection object is placed in the movable housing, the engagement and electrical connection can be completed by moving the manipulation housing. The movable connector of the invention can facilitate the operation of the engagement and electrical connection.

In the movable connector, the circuit-board connection terminal may have a pair of the contact portions, and the pair of the contact portions may be disposed so as to pinch the connection object. In addition, the contact reinforcing portion may have a first pressing portion that presses one of the contact portions and a second pressing portion that presses the other one of the contact portions.

According to this configuration, the first pressing portion presses one contact portion, and the second pressing portion presses the other contact portion. The one and the other contact portions pinch the connection object. The first pressing portion and the second pressing portion can enhance the respective contact pressure of the one and the other contact portions that pinch the connection object.

In the movable connector, the contact portion may have a first contact point that comes into press-contact with the connection object and a second contact point with which the contact reinforcing portion comes into press-contact. The contact portion may also have a spring portion that links the first contact point and the second contact point and that urges the first contact point against the connection object by using a reaction force generated due to the second contact point coming into press-contact with the contact reinforcing portion.

According to this configuration, the first contact point is pressed against the connection object by utilizing a reaction force generated due to the second contact point being pressed by the contact reinforcing portion. Thus, the contact pressure of the first contact point against the connection object can be increased.

In the movable connector, the contact reinforcing portion may have a projection, and the manipulation housing may have a retaining groove that movably holds the projection via a gap provided between the retaining groove and the projection. The gap thereby enables the contact reinforcing portion to move relative to the manipulation housing.

According to this configuration, the contact reinforcing portion is not fixed to but is movable relative to the manipulation housing. As a result, even if the circuit-board connection terminal or the connection object comes deviatingly into contact with the contact reinforcing portion, the contact reinforcing portion can be displaced so as to absorb the deviation, and thereby a reliable electrical contact can be obtained.

The manipulation housing and the movable housing may have temporary engagement retaining portions that restrain the manipulation housing from moving in a direction of the operation of moving the manipulation housing and in a direction opposite thereto in a temporary engagement state before an engagement state in which the manipulation housing and the movable housing are coupled to each other. With this configuration, the temporary engagement retaining portions restrain the manipulation housing from moving relative to the movable housing, which can eliminate a problem that the manipulation housing comes off the movable housing in the temporary engagement state.

Thus, the movable connector of the invention enables a stable electrical connection with easy engagement.

DESCRIPTION OF THE PREFERRED EMBODIMENTS

Figure 1:
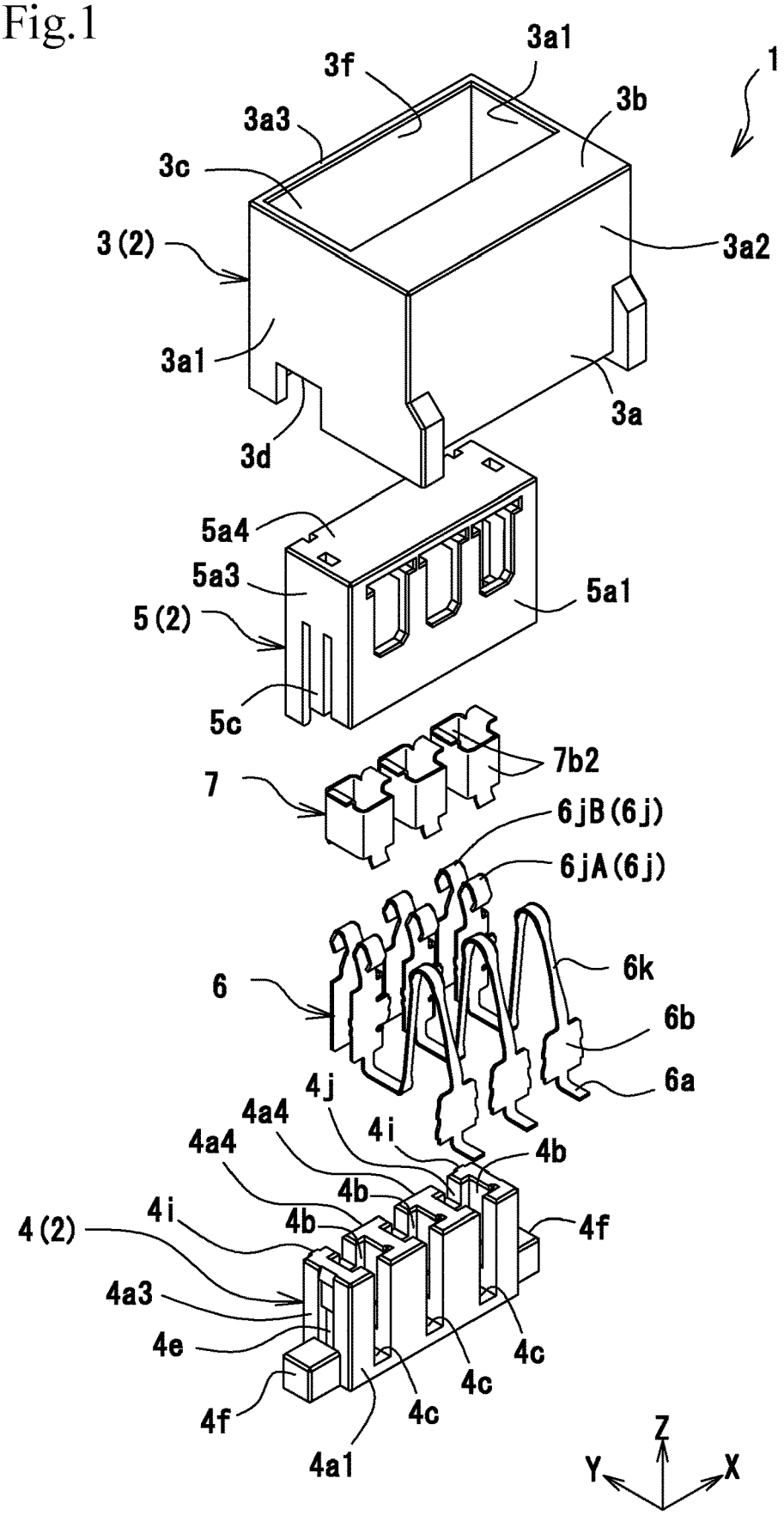
FIG. 1 is an exploded perspective view illustrating a movable connector according to a first embodiment, in which the front side, the left side, and the top side of the movable connector are shown.

Embodiments will be described with reference to the drawings. An embodiment of a bottom entry type movable connector 1 will be described below. In the present specification, claims, and drawings, a direction in which a plurality of terminals of the movable connector 1 are arrayed (right-left direction) as illustrated in FIG. 1 is represented by the X direction, the depth direction (front-rear direction) of the movable connector 1 is represented by the Y direction, and the height direction (up-down direction) of the movable connector 1 is represented by the Z direction. Note that the definitions of the above directions should not be construed as limiting the direction in which the movable connector of the present invention is mounted or is used. In the present specification and claims, terms "first" and "second" are used to distinguish different elements of the invention from each other and are not used to imply a specific order nor to imply that one is better than the other.

Configuration of Movable Connector 1

The movable connector 1 includes a housing 2 formed of a molding of a hard resin. The housing 2 includes a fixed housing 3, a movable housing 4, and a manipulation housing 5. A circuit-board connection terminal 6 made of a metal piece is fixed to the fixed housing 3 and to the movable housing 4. A contact reinforcing member 7 is held by the manipulation housing 5. The contact reinforcing member 7 serves as a "contact reinforcing portion".

Fixed Housing 3

Figure 9:
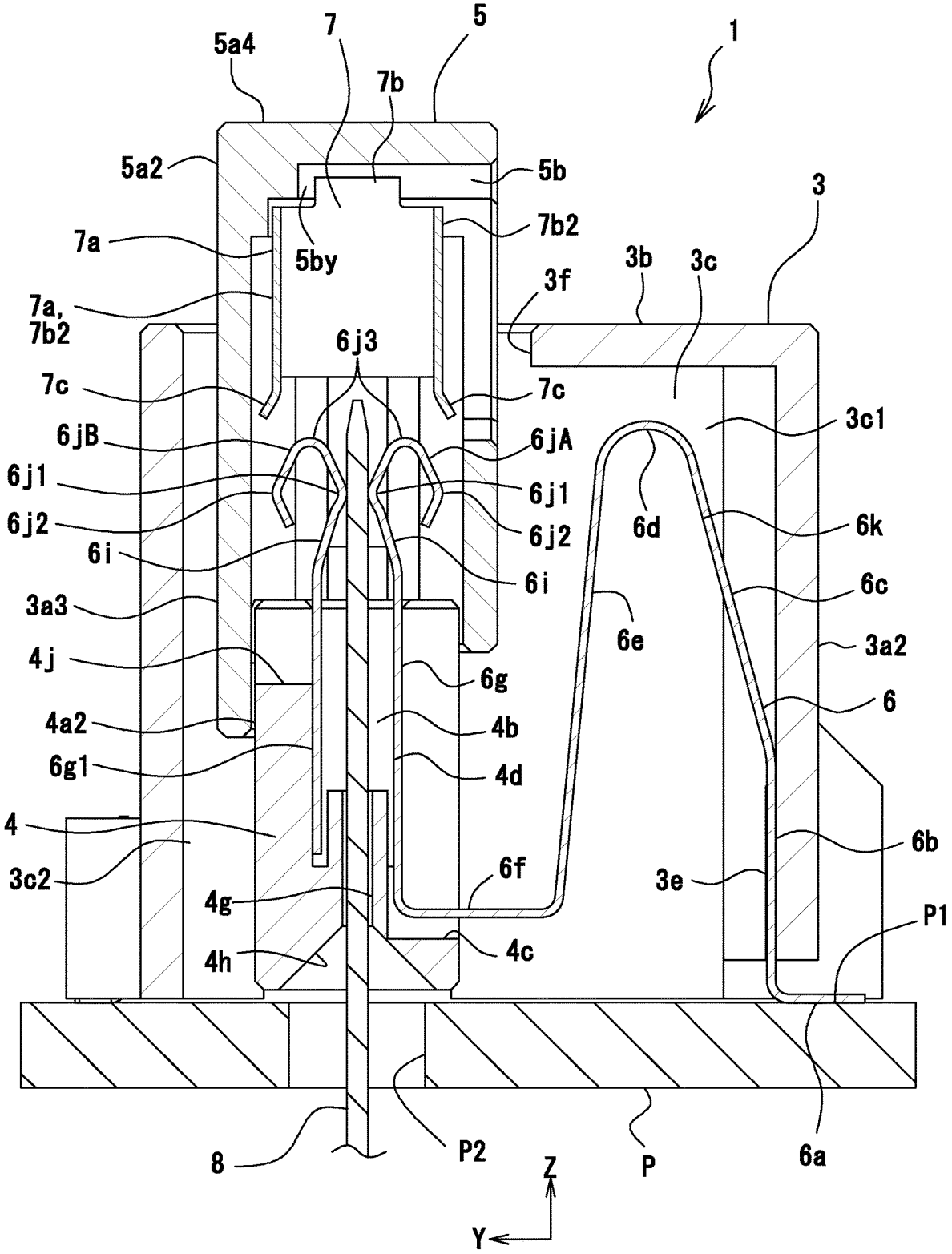
FIG. 9 is a cross section cut along line IX-IX of FIG. 2, illustrating an engagement process of the movable connector.
Figure 10:
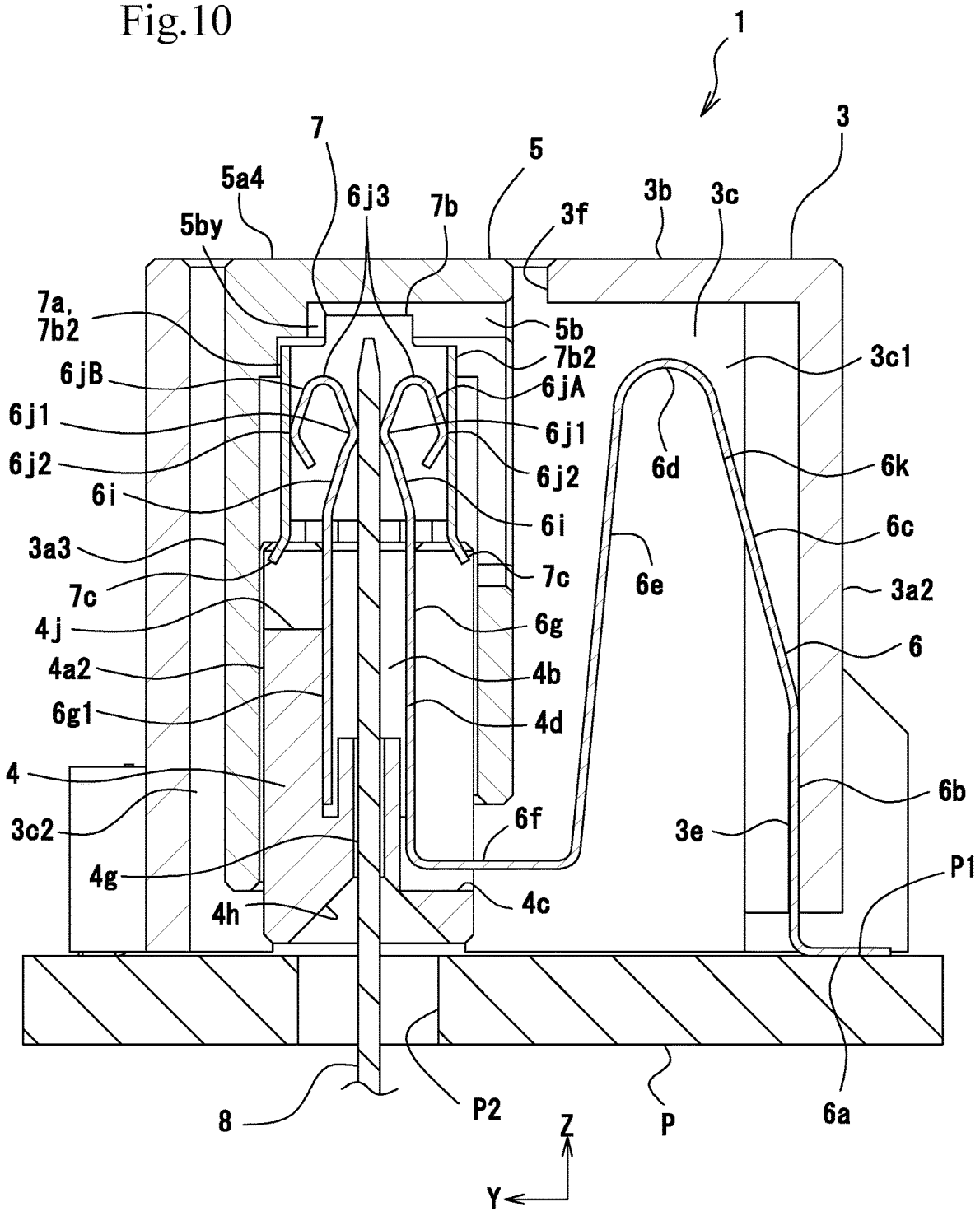
FIG. 10 is a cross-sectional view illustrating an engagement state of the movable connector of FIG. 2 following the state illustrated in FIG. 9.
Figure 11:
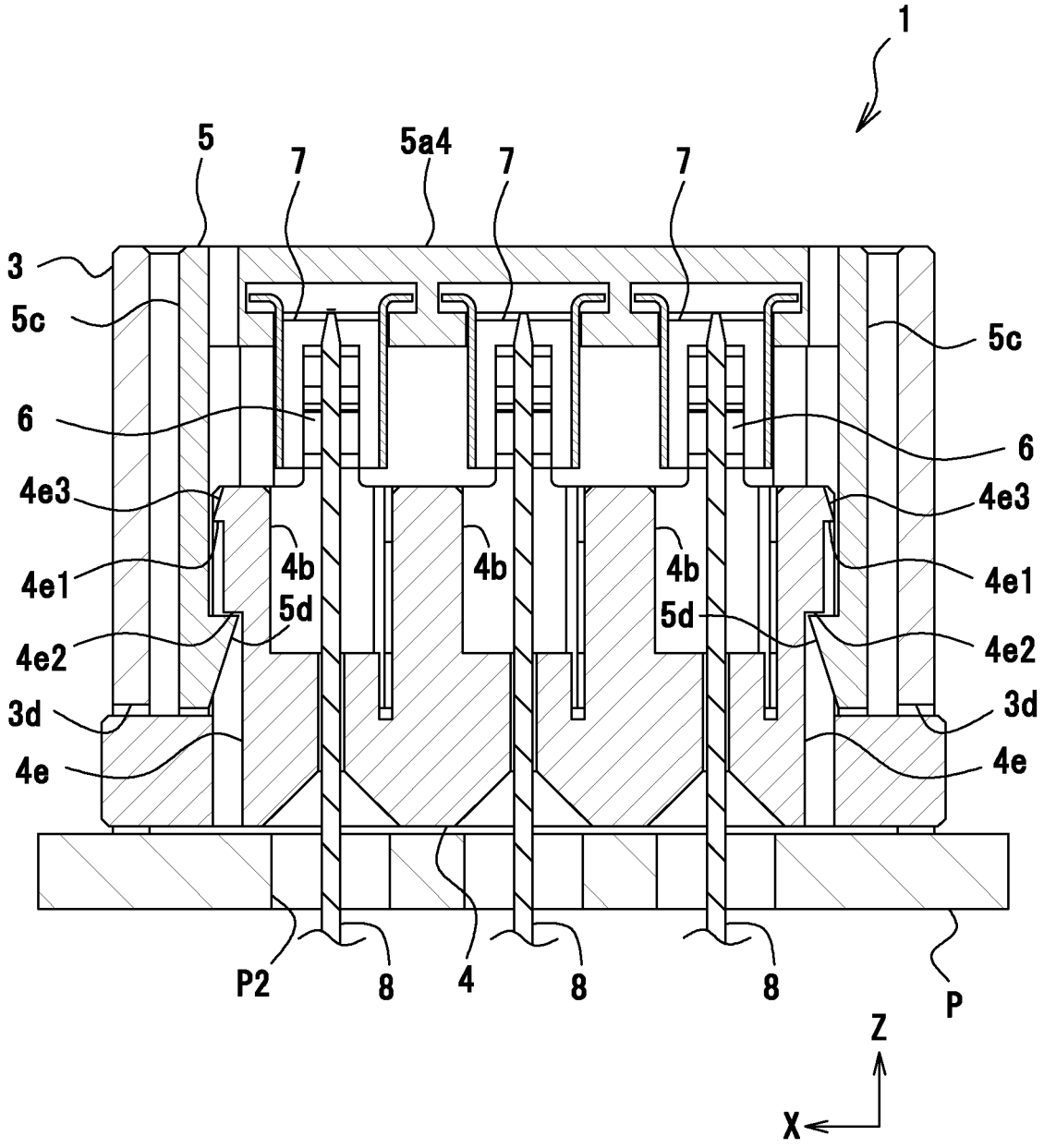
FIG. 11 is a cross-sectional view illustrating an engagement state of the movable connector of FIG. 2 following the state illustrated in FIG. 6.

The fixed housing 3 is mounted on a circuit board P (see FIG. 9). The fixed housing 3 is shaped like a box and has peripheral walls 3*a* and a top wall 3*b* that covers a front region, in the Y direction, of a space surrounded by the peripheral walls 3*a* and also covers corresponding top ends of the peripheral walls 3*a*. The space inside the fixed housing 3 is an internal space 3*c*.

The peripheral walls 3*a* include right and left side walls 3*a*1. Stopper recesses 3*d* are formed at respective bottoms of the side walls 3*a*1. The stopper recesses 3*d* engage stopper projections 4*f* of the movable housing 4, which will be described later. The peripheral walls 3*a* also include a front wall 3*a*2 and a rear wall 3*a*3. A terminal fixation portion 3*e* is formed inside the front wall 3*a*2. The terminal fixation portion 3*e*, which is formed as a groove, pinches a fixed housing fixation portion 6*b* of the circuit-board connection terminal 6 in the X direction (see FIG. 9), which will be described later.

The top wall 3*b* is provided above a support spring portion 6*k* of the circuit-board connection terminal 6 (to be described later) so as to cover the support spring portion 6*k* (see FIG. 9). The top wall 3*b* thereby protects the support spring portion 6*k* from being exposed to the outside. A region surrounded by the top ends of the peripheral walls 3*a* and not covered by the top wall 3*b* is an insertion opening 3*f* through which the manipulation housing 5 is inserted. The insertion opening 3*f* is formed so as to have a size larger than the outer periphery of the manipulation housing 5.

In the internal space 3*c*, a region under the top wall 3*b* is a support spring accommodation region 3*c*1 in which the support spring portion 6*k* of the circuit-board connection terminal 6 extends and that allows the support spring portion 6*k* to deform elastically. A region under the insertion opening 3*f* is a housing accommodation region 3*c*2 that accommodates the manipulation housing 5 and the movable housing 4. Accordingly, the internal space 3*c* of the fixed housing 3 includes a plurality of accommodation spaces, in other words, the support spring accommodation region 3*c*1 and the housing accommodation region 3c2, which are arranged side by side in the Y direction. By providing the internal space 3c with the support spring accommodation region 3c1 separately from the housing accommodation region 3c2, the support spring accommodation region 3c1 serves as a space for the support spring portion 6k to extend, bend, and deform, which enables the support spring portion 6k to have a large spring length without complicating the shape of the support spring portion 6k.

Figure 3:
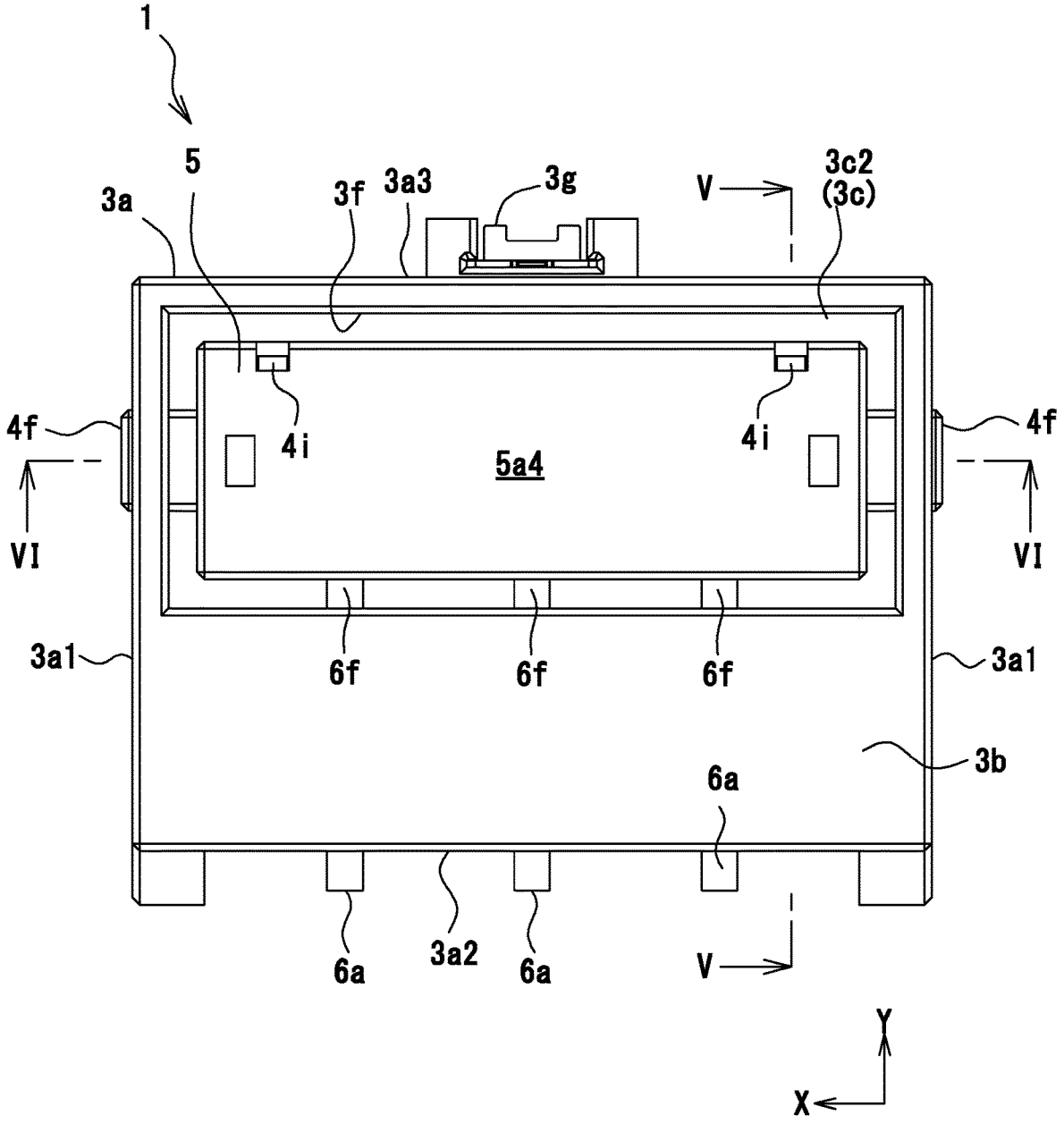
FIG. 3 is a plan view illustrating the movable connector assembled from the state in FIG. 1.

A fixation metal fitting 3g, which is to be soldered to the circuit board P, is attached to the rear wall 3a3 of the fixed housing 3 (see FIG. 3). The fixation metal fitting 3g is fixed to the circuit board P with a soldering section (not illustrated) being interposed therebetween.

Movable Housing 4

Similarly to the fixed housing 3, the movable housing 4 is elongated in the X direction and has a front wall 4a1, a rear wall 4a2, and right and left side walls 4a3. In addition, two partition walls 4a4 that are elongated in the Y direction between the front wall 4a1 and the rear wall 4a2 are formed (see FIG. 1), thereby defining three pass-through chambers 4b separated from each other in the X direction in the movable housing 4. A pin terminal 8, otherwise referred to as a "connection object", is inserted into each of the pass-through chambers 4b. A base portion 6g of the circuit-board connection terminal 6 (to be described later) is also disposed in each of the pass-through chambers 4b.

Slit-shaped pass-through openings 4c are formed in the front wall 4a1 (see FIG. 1). Each pass-through opening 4c enables corresponding pass-through chamber 4b to communicate with the outside of the movable housing 4 in the Y direction. A horizontal bend portion 6f of the support spring portion 6k of the circuit-board connection terminal 6 is disposed in each pass-through chamber 4b (see FIG. 9). A terminal fixation portion 4d is formed on the inside surface of the front wall 4a1. The terminal fixation portion 4d that is formed as a groove pinches a movable-housing fixation portion 6h of the circuit-board connection terminal 6 in the X direction (see FIG. 9), which will be described later.

Figure 6:
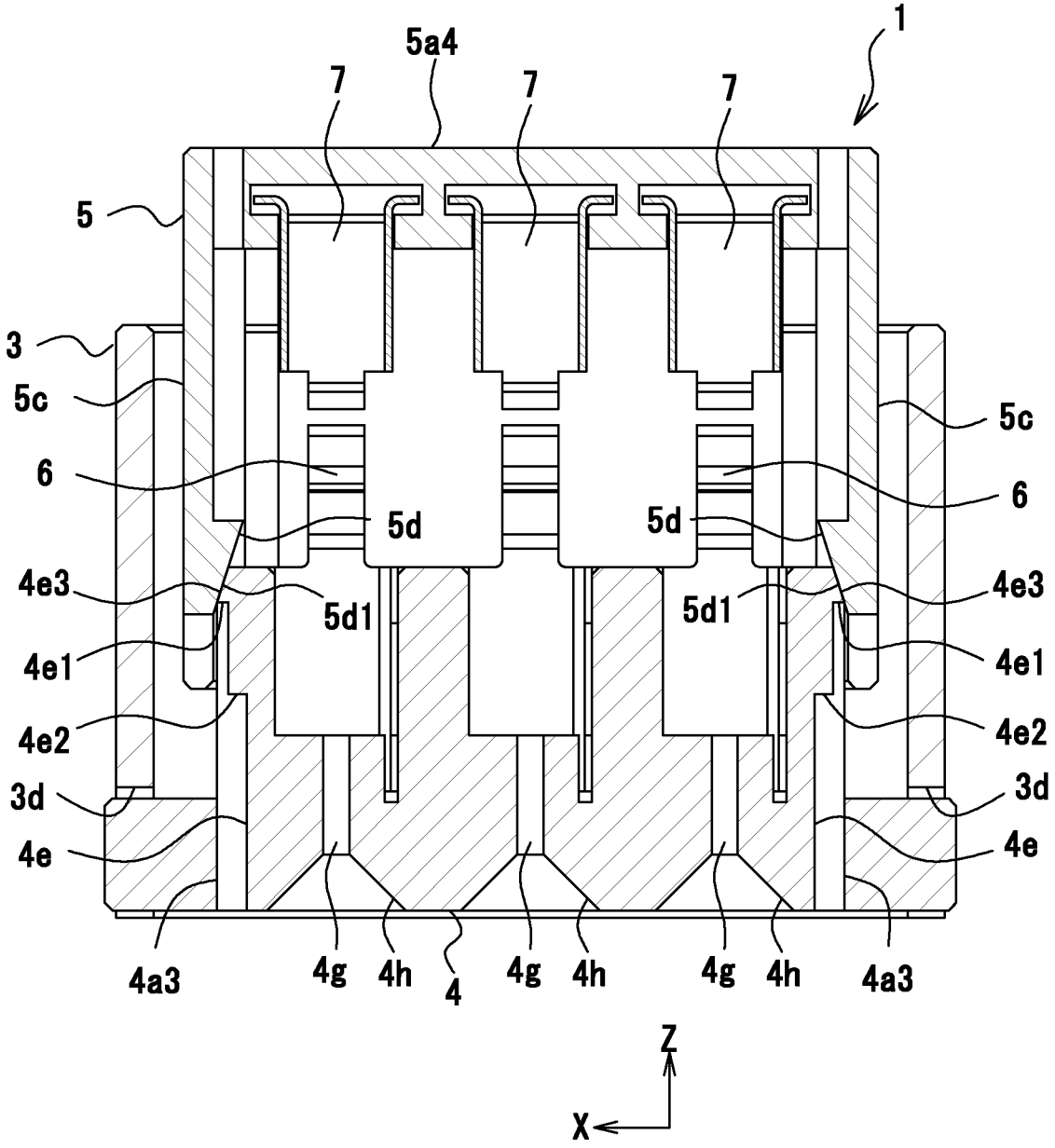
FIG. 6 is a cross section cut along line VI-VI of FIG. 3.

Recesses 4e, which are shaped like grooves extending in the Z direction, are formed in the right and left side walls 4a3 (see FIGS. 1 and 6). A first stopper step 4e1 is formed in an upper portion of each of the recesses 4e, and a second stopper step 4e2 is also formed therebelow. The function of these stopper steps is to prevent the manipulation housing 5 from pulling out of the movable housing 4.

Stopper projections 4f project outward at respective bottom ends of the side walls 4a3. The stopper projections 4f engage respective stopper recesses 3d of the fixed housing 3 and thereby function as stoppers that prevents further displacement of the movable housing 4 when the movable housing 4 is displaced excessively in the Y direction or in the Z direction in the internal space 3c of the fixed housing 3.

An insertion hole 4g for insertion of a connection object is formed at the bottom of each pass-through chamber 4b. An insertion guide surface 4h is formed at the entrance of the insertion hole 4g for guiding a pin terminal 8 during insertion.

Figure 5:
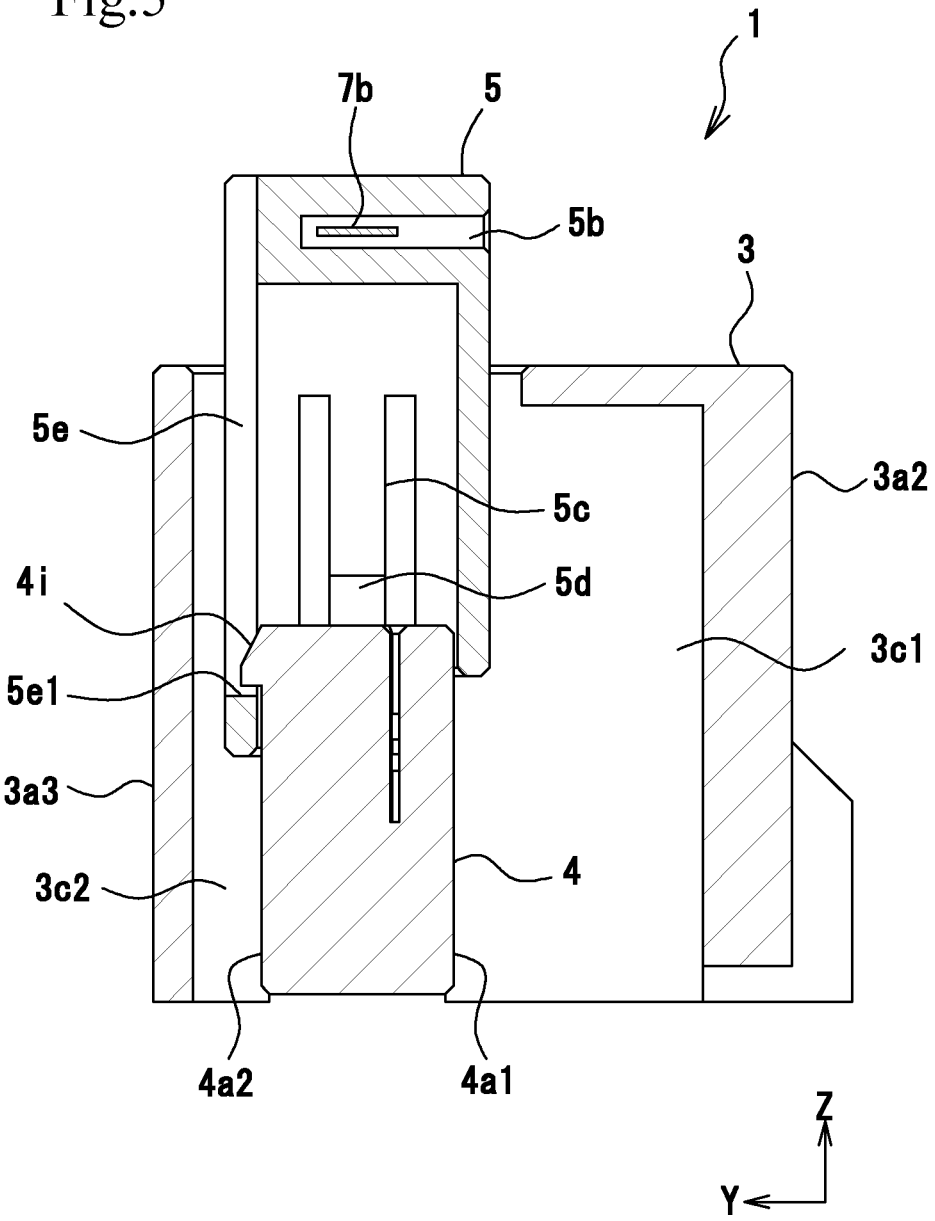
FIG. 5 is a cross section cut along line V-V of FIG. 3.

Temporary engagement projections 4i are formed at the top end of the movable housing 4 near the positions where the rear wall 4a2 meets respective right and left side walls 4a3 (see FIGS. 1, 3, and 5). The temporary engagement projections 4i enter respective engagement guides 5e formed in the manipulation housing 5 (to be described later) and thereby guide the manipulation housing 5 that is displaced relative to the movable housing 4. Moreover, the temporary engagement projections 4i prevent the manipulation housing 5 from pulling out of the movable housing 4. The temporary engagement projections 4i and the engagement guides 5e are "temporary engagement retaining portions".

Recesses 4j are formed in the rear wall 4a2 by removing respective portions of the rear wall 4a2. The recesses 4j are provided to avoid contact between the movable housing 4 and contact guide projections 7c of the contact reinforcing members 7 (to be described later) when the manipulation housing 5 completely engages the movable housing 4. Thus, the height of the movable connector 1 is reduced compared with the case in which the recesses 4j are not provided.

Manipulation Housing 5

Similarly to the fixed housing 3 and the movable housing 4, the manipulation housing 5 is elongated in the X direction and has a front wall 5a1, a rear wall 5a2, right and left side walls 5a3, and a top wall 5a4. Two partition walls 5a5 are formed between the front wall 5a1 and the rear wall 5a2 (see FIG. 2). The two partition walls 5a5 are elongated in the Y direction and protrude downward in the Z direction from the bottom side of the top wall 5a4. Retaining grooves 5b, which extend in the Y direction, are formed in the base portions of the partition walls 5a5 and on the inside surfaces of the right and left side walls 5a3 that oppose corresponding base portions in the X direction. Stopper projections 7b of each contact reinforcing member 7 are inserted into corresponding retaining grooves 5b.

Locking arms 5c are formed in the right and left side walls 5a3. The locking arms 5c extend downward in the Z direction (see FIGS. 1, 4B, etc.). The locking arms 5c enter respective recesses 4e and move along the recesses 4e in the longitudinal direction thereof when the manipulation housing 5 engages the movable housing 4.

A locking projection 5d is formed in each of the locking arms 5c. When the manipulation housing 5 is pressed onto the movable housing 4, each locking arm 5c moves along the recess 4e, and the locking projection 5d first passes the first stopper step 4e1 (see FIG. 6). The locking projection 5d becomes engageable with the first stopper step 4e1 in a withdrawing direction in which the manipulation housing 5 is withdrawn from the movable housing 4. The locking projection 5d thereby prevents the manipulation housing 5 from being withdrawn from the movable housing 4. Pressing the manipulation housing 5 further causes the locking projection 5d to pass the second stopper step 4e2 and to be engageable with the second stopper step 4e2 in the withdrawing direction. Consequently, the manipulation housing 5 enters a complete engagement state in which the manipulation housing 5 engages the movable housing 4 completely. The locking arms 5c and the first stopper steps 4e1 are "temporary engagement retaining portions" as is the case for the temporary engagement projections 4i. In addition, the locking arms 5c and the second stopper steps 4e2 constitute "engagement retaining portions".

In the process of pressing the manipulation housing 5 onto the movable housing 4, each of the locking projections 5d passes the first stopper step 4e1 and the second stopper step 4e2. Each second stopper step 4e2 is formed one stage deeper in the recess 4e compared with the corresponding first stopper step 4e1, and accordingly the locking arm 5c is subjected to a less amount of bending. In other words, the amount of bending of the locking arm 5c becomes greater after the first stopper step 4e1 and becomes smaller after the second stopper step 4e2. For example, if only the first stopper step 4e1 is provided, the locking arm 5c continues to bend until the manipulation housing 5 engages the movable housing 4 completely. Continuous bending of the locking arm 5c causes the manipulation housing 5 to tend to move sluggishly due to a sliding contact force of the locking arm 5c acting on the manipulation housing 5. However, by providing a plurality of stopper steps (4e1 and 4e2) with the stopper steps being deeper step by step as described above, the amount of bending of the locking arm 5c can be reduced accordingly. This makes it easier to perform the pressing operation of the manipulation housing 5.

Figure 4A:
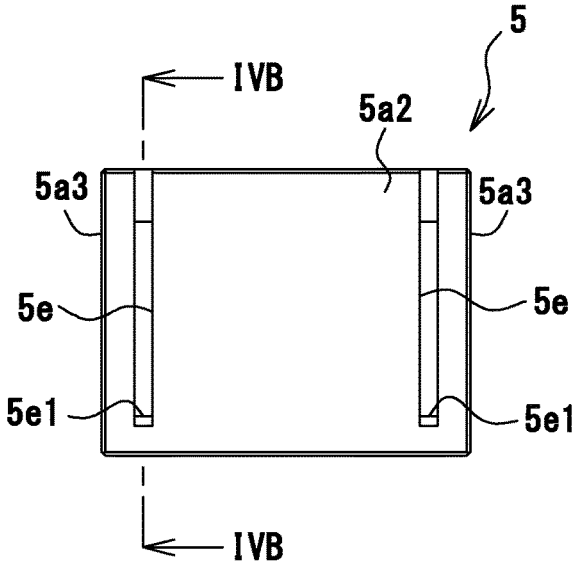
FIG. 4A is a rear view illustrating a manipulation housing included in the movable connector of FIG. 1.
Figure 4B:
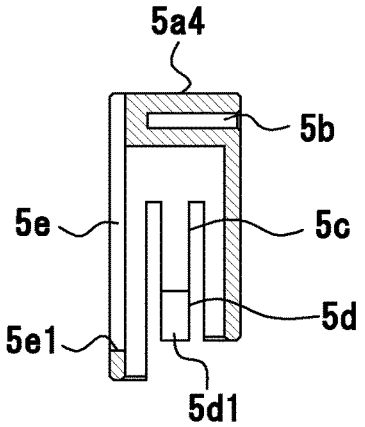
FIG. 4B is a cross section cut along line IVB-IVB of FIG. 4A.
Figure 4C:
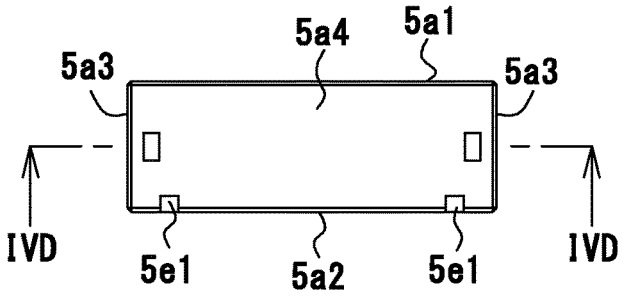
FIG. 4C is a plan view illustrating the manipulation housing of FIG. 4A.
Figure 4D:
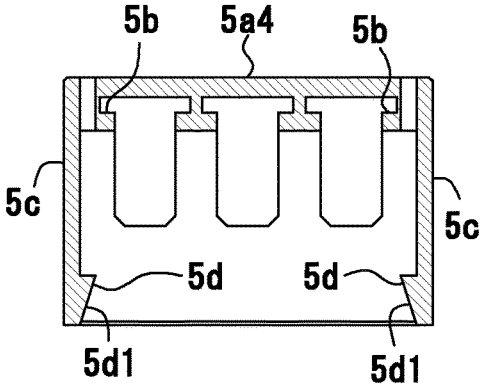
FIG. 4D is a cross section cut along line IVD-IVD of FIG. 4C.

An inclined surface 5d1 is formed on the locking projection 5d (see FIG. 4D). As illustrated in FIG. 6, the inclined surface 5d1 rests on the inclined surface 4e3 of the first stopper step 4e1 while in the "temporary engagement state". This regulates a further operation of pressing the manipulation housing 5 and thereby maintains the "temporary engagement state". To cause the manipulation housing 5 to engage the movable housing 4, the manipulation housing 5 is pressed into the internal space 3c of the fixed housing 3 from the "temporary engagement state". This pressing operation causes the inclined surface 5d1 of the locking projection 5d to slide along the inclined surface 4e3 in the Z direction and causes the locking arm 5c to bend outward and to slide over the first stopper step 4e1 and then to pass the second stopper step 4e2. As a result, the manipulation housing 5 and the movable housing 4 enter the complete engagement state.

The top wall 5a4 serves as a portion to be pressed during the pressing operation of the manipulation housing 5. The entire surface of the top wall 5a4 is formed into a flat surface so as to facilitate the pressing operation especially for a small movable connector 1. When the manipulation housing 5 and the movable housing 4 are in the complete engagement state, the top wall 5a4 is flush with the top wall 3b of the fixed housing 3. Protrusion of the top wall 5a4 above the top wall 3b of the fixed housing 3 indicates that the manipulation housing 5 is in the process of engaging the movable housing 4. Accordingly, the engagement state can be determined by observing the position of the top wall 5a4.

As illustrated in FIG. 4A, two slit-shaped engagement guides 5e are formed on the rear wall 5a2 of the manipulation housing 5. The engagement guides 5e are formed so as to extend in the height direction (in the Z direction) of the manipulation housing. As described above, the engagement guides 5e receive therein the temporary engagement projections 4i of the movable housing 4. FIG. 5 illustrates this state. When the manipulation housing 5 illustrated in FIG. 5 is pulled out of the movable housing 4, a stopper wall 5e1 of each of the engagement guides 5e engages a corresponding temporary engagement projection 4i in a withdrawing direction, which prevents the manipulation housing 5 from being withdrawn unintentionally from the movable housing 4. FIG. 5 and FIG. 6 illustrate the same temporary engagement state of the movable connector 1. Thus, the manipulation housing 5 does not move easily in the pressing direction without performing the pressing operation, while the manipulation housing 5 is not pulled out easily in the withdrawing direction.

Circuit-Board Connection Terminal 6

Figure 8:
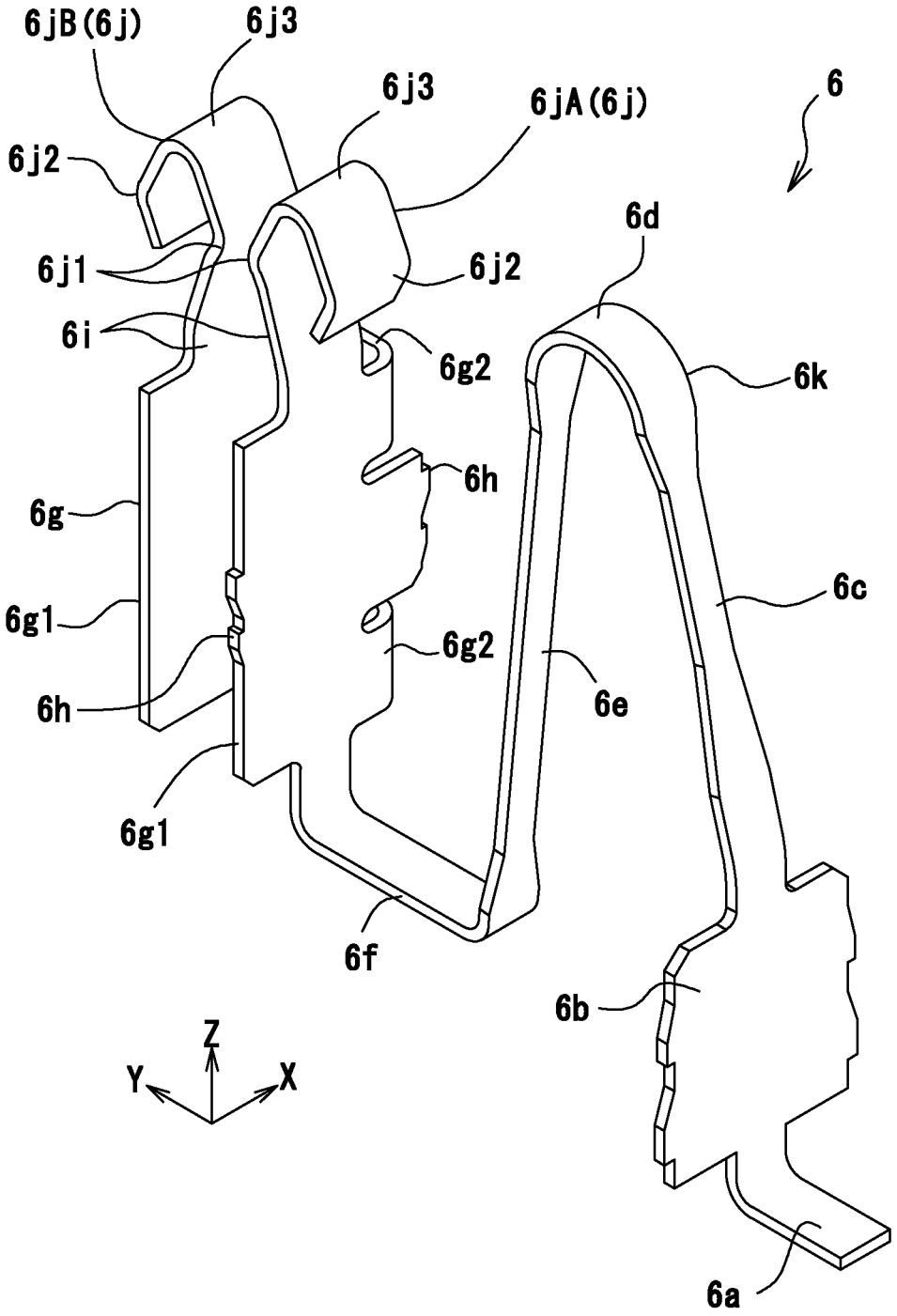
FIG. 8 is perspective view illustrating a circuit-board connection terminal included in the movable connector of FIG. 1.

Circuit-board connection terminals 6 are arranged parallel to each other in a row in the X direction in the movable connector 1. The circuit-board connection terminals 6 have the same shape. More specifically, as illustrated in FIG. 8, each of the circuit-board connection terminals 6 has a circuit-board connection portion 6a, a fixed housing fixation portion 6b for fixation to the fixed housing, an outer standing portion 6c, a turnaround portion 6d, an inner standing portion 6e, a horizontal bend portion 6f, a base portion 6g, a movable-housing fixation portion 6h for fixation to the movable housing, a pair of elastic arms 6i,and a pair of contact portions 6j.

The circuit-board connection portion 6a is a portion to be fixed to the circuit board P via the soldering section P1 (see FIG. 9) and thereby electrically connected to the circuit on the circuit board P. The fixed housing fixation portion 6b is press-fitted into and held by the terminal fixation portion 3e formed on the inside surface of the front wall 3a2 of the fixed housing 3 (see FIG. 9). An end portion of each circuit-board connection terminal 6 is thereby fixed to the fixed housing 3. The outer standing portion 6c, the turnaround portion 6d, the inner standing portion 6e, and the horizontal bend portion 6f serve as the support spring portion 6k that supports the movable housing 4 and the manipulation housing 5 elastically and displaceably with respect to the fixed housing 3. The support spring portion 6k is formed into an inverse U-shape and deforms elastically in the X, Y, and Z directions inside the support spring accommodation region 3c1 of the fixed housing 3. The support spring portion 6k thus supports the movable housing 4 and the manipulation housing 5 that are displaced relative to each other in the X, Y, and Z directions. The horizontal bend portion 6f extends straight in the Y direction so as to pass over the edge of the pass-through opening 4c of the movable housing 4. The base portion 6g is shaped such that a pair of plate leaves 6g1 that extend in the X direction and oppose each other in the Y direction are linked by connection plate portions 6g2 that extend in the Y direction. A plurality of press-fit projections are formed at side ends of a front one of the plate leaves 6g1 and are press-fitted into the terminal fixation portion 4d of the movable housing 4. The press-fit projections constitute the movable-housing fixation portion 6h.

The base ends of the elastic arms 6i continue to respective top ends of a pair of the plate leaves 6g1. The elastic arms 6i function as spring leaves that displaceably supports the contact portions 6j and provides a contact pressure to press the contact portions 6j against a pin terminal 8.

A pair of the contact portions 6j constitute "contact portions" according to the invention. Similarly, a first contact portion 6jA that is located in front in the Y direction constitutes "one of the contact portions", whereas a second contact portion 6jB that is located in rear in the Y direction constitutes the "other one of the contact portions". The first contact portion 6jA and the second contact portion 6jB directly pinch a pin terminal 8, or otherwise referred to as a connection object, and are in electrical contact with the pin terminal 8. With this configuration, a highly reliable electrical connection can be achieved compared with, for example, a connection structure in which a pair of contact portions 6j come into contact with the pin terminal 8 indirectly. The first contact portion 6jA and the second contact portion 6jB include inner contact points 6j1 that continue to the elastic arms 6i, outer contact points 6j2, and spring portions 6j3. According to the present invention, the inner contact points 6j1 constitute a "first contact point" and the outer contact points 6j2 constitute a "second contact point". The inner contact points 6j1 come into electrical contact with the pin terminal 8 with a predetermined contact pressure. The outer contact points 6j2 come into press-contact with the contact reinforcing member 7, which will be described later. The spring portions 6j3 link respective inner contact points 6j1 to the outer contact points 6j2. The spring portions 6j3 function such that when the outer contact points 6j2 come into press-contact with the contact reinforcing member 7, the outer contact points 6j2 receive reaction forces from the contact reinforcing member 7 and thereby urge the inner contact points 6j1 against the pin terminal 8. Thus, the outer contact points 6j2 and the spring portions 6j3 are capable of increasing the contact pressure of the inner contact points 6j1 that come into press-contact with the pin terminal 8.

Contact Reinforcing Member 7

Figure 7:
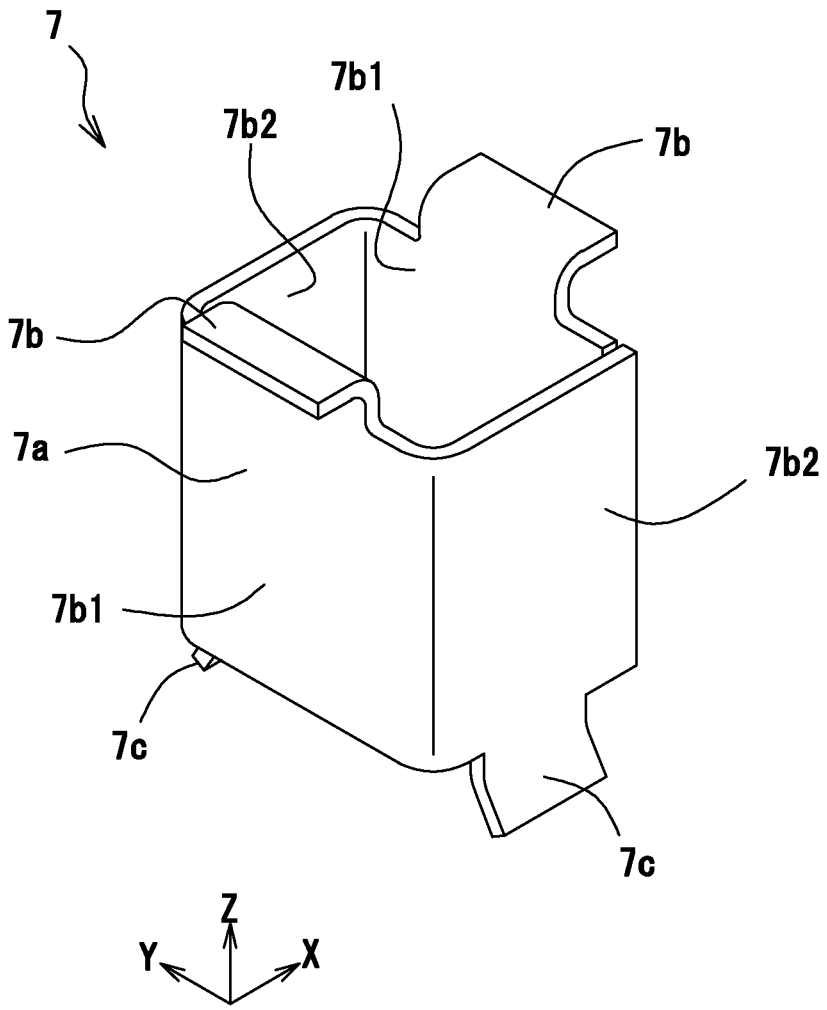
FIG. 7 is perspective view illustrating a contact reinforcing member included in the movable connector of FIG. 1.

As illustrated in FIG. 7, the contact reinforcing member 7, which serves as a "contact reinforcing portion" of the manipulation housing 5, includes a base portion 7*a*, stopper projections 7*b* or otherwise referred to as "projections", and contact guide projections 7*c*. Note that the contact reinforcing member 7 according to the present embodiment is formed of a metal piece.

In the embodiment, the base portion 7*a* is shaped like a piece of a square tube. The base portion 7*a* has a pair of first side walls 7*b*1 with stopper projections 7*b* formed at respective top ends thereof and a pair of second side walls 7*b*2 with a pair of the contact guide projections 7*c* formed at respective bottom ends thereof. In the present invention, a front one of the second side walls 7*b*2 in the Y direction constitutes a "first pressing portion", and a rear one of the second side walls 7*b*2 in the Y direction constitutes a "second pressing portion".

The stopper projections 7*b* are formed as flanges that protrude outward from respective top ends of the first side walls 7*b*1. The stopper projections 7*b* are to be inserted into the retaining grooves 5*b* of the manipulation housing 5. The stopper projections 7*b* are inserted into the retaining grooves 5*b* so as to have gaps therebetween, which enables the contact reinforcing member 7 to move relative to the movable housing 4. Thus, the stopper projections 7*b* and the retaining grooves 5*b* constitute "movably retaining portions" that can hold the contact reinforcing member 7 movably relative to the movable housing 4.

Figure 2:
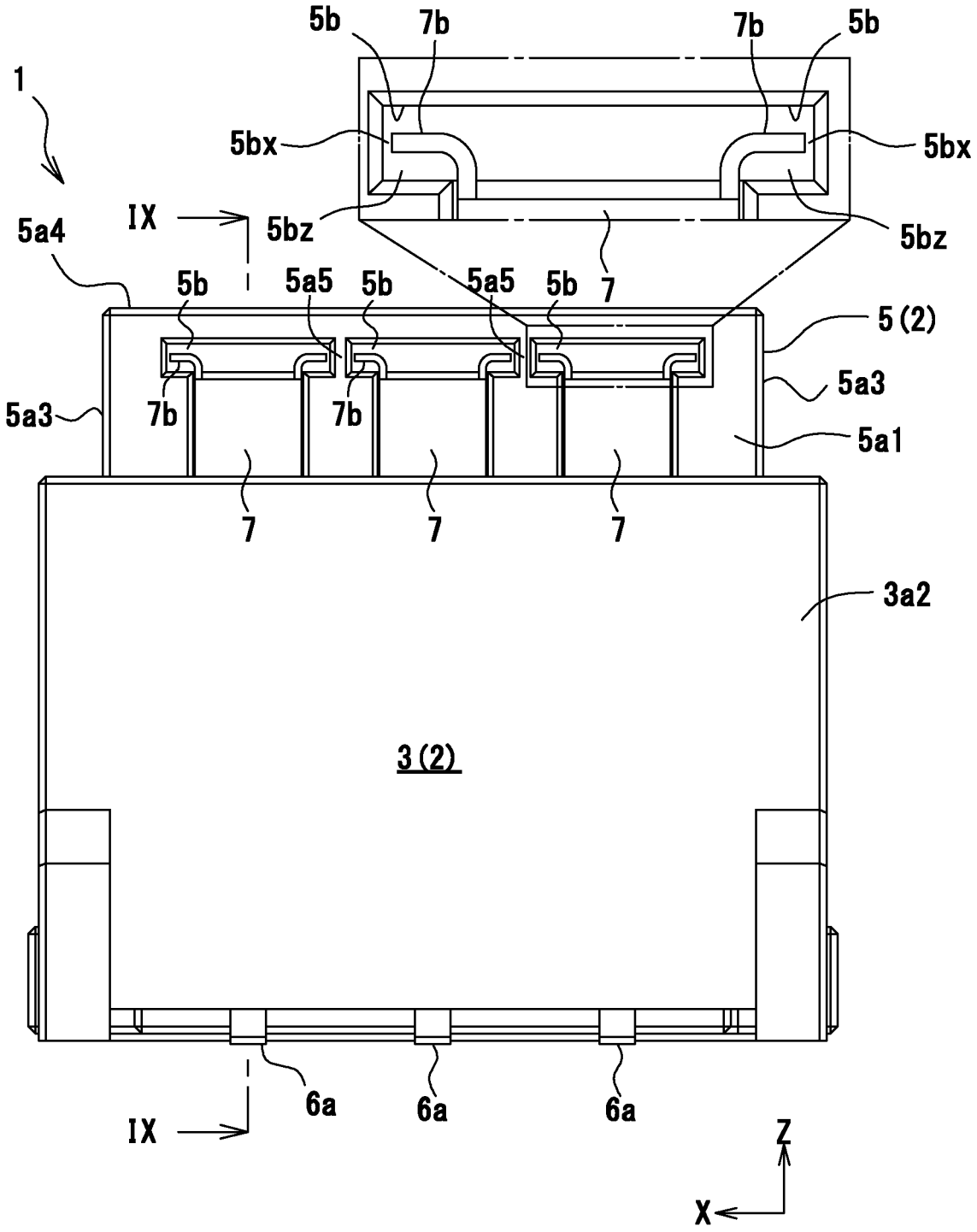
FIG. 2 is a front view illustrating the movable connector assembled from the state in FIG. 1.

In other words, by inserting the stopper projections 7*b* into the retaining grooves 5*b* of the manipulation housing 5, the contact reinforcing member 7 is held by the manipulation housing 5 without being fixed thereto. Between the stopper projections 7*b* and respective retaining grooves 5*b*, as illustrated in FIG. 2, there are formed a gap 5*bx* that extends in the X direction, a gap 5*bz* that extends in the Z direction. As illustrated in FIG. 9, a gap 5*by* that extends in the Y direction is also formed. Thus, the stopper projections 7*b* can move inside the retaining grooves 5*b* in the X, Y, and Z directions. As a result, the contact reinforcing member 7 is movably mounted on the manipulation housing 5 so that the contact reinforcing member 7 can be displaced in the X, Y, and Z directions.

Operation and Advantageous Effect of Movable Connector 1

Next, operation and advantageous effects of the movable connector 1 will be described except for what has been described.

Assembly of Movable Connector 1

The movable connector 1 is assembled in the following manner. First, the movable-housing fixation portions 6*h* of the circuit-board connection terminals 6 are fixed to respective terminal fixation portions 4*d* of the movable housing 4, and the contact reinforcing members 7 are mounted in the manipulation housing 5. Subsequently, the manipulation housing 5 is put on the movable housing 4 and allows the movable housing 4 to be inserted therein. At this time, the manipulation housing 5 is mounted in such a manner that the temporary engagement projections 4*i* of the movable housing 4 are hooked from below to the engagement guides 5*e* of the manipulation housing 5. The movable housing 4 and the manipulation housing 5 thereby enter the "temporary engagement state".

Next, the manipulation housing 5 is inserted into the internal space 3*c* of the fixed housing 3 from below, and thereby the top end of the manipulation housing 5 protrudes out of the insertion opening 3*f*. Meanwhile, the fixed housing fixation portions 6*b* of the circuit-board connection terminals 6 are press-fitted into respective terminal fixation portions 3*e* of the fixed housing 3. Thus, the components are mounted in the fixed housing 3, and the movable connector 1 is thereby assembled. The circuit-board connection portions 6*a* of the circuit-board connection terminals 6 and the fixation metal fitting 3*g* are soldered onto the circuit board P. Thus, the movable connector 1 is mounted on the circuit board P.

Electrical Connection of Pin Terminal 8 (Connection Object) to Movable Connector 1

The following describes operation and advantageous effects of the movable connector 1 when pin terminals 8 are electrically connected to the movable connector 1.

Pin terminals 8 are inserted from the back side of the circuit board P into the movable connector 1 through respective through holes P2. A tapered insertion guide surface 4*h* is formed in each of the insertion holes 4*g* of the movable housing 4. Even if the central axis of each pin terminal 8 is not aligned with the axis of the corresponding insertion hole 4*g*, the insertion guide surface 4*h* guides the pin terminal 8 and can correct the insertion direction. The movable housing 4 and the manipulation housing 5 are supported by the support spring portions 6*k* of the circuit-board connection terminals 6 so as to be able to move three-dimensionally. Accordingly, displacement of the movable housing 4 and the manipulation housing 5 can absorb positioning deviation of the pin terminals 8. In this case, the movable amounts of the movable housing 4 in the front-rear direction (Y direction) and in the height direction (Z direction) are determined by the gaps between the stopper projections 4*f* and corresponding stopper recesses 3*d* of the fixed housing 3. In addition, the movable amount of the movable housing 4 in the right-left direction (X direction) is determined by the gap between the manipulation housing 5 and the fixed housing 3. Accordingly, these gaps restrains an excessive displacement of the movable housing 4.

As each pin terminal 8 is inserted further therein, as illustrated in FIG. 9, the pin terminal 8 passes through the insertion hole 4*g* of the movable housing 4 and is inserted between a pair of the contact portions 6*j* that oppose each other. Thus, the pin terminal 8 is electrically connected to the circuit-board connection terminal 6. At this time, the pin terminal 8 is pinched by a pair of the inner contact points 6*j*1 with a predetermined contact pressure. The movable connector 1 is provided with the contact reinforcing members 7, and each of the contact reinforcing members 7 reinforces the contact pressure of the inner contact points 6*j*1 exerted on each pin terminal 8, which will be described later. Accordingly, in the temporary engagement state in which each pin terminals 8 is not affected by the contact reinforcing member 7 (see FIG. 9), the contact pressure exerted on the pin terminal 8 by the inner contact points 6*j*1 need not be high. When the movable connector 1 enters the complete engagement state, the contact reinforcing member 7 reinforces the contact pressure. Accordingly, the movable connector 1 of the present embodiment may be configured to have a zero insertion force structure (ZIF structure) that does not require an insertion force for insertion of the pin terminal 8 or a low insertion force structure (LIF structure).

When the movable connector 1 is configured to have the ZIF structure, the gap between a pair of free-state inner contact points 6*j*1 is made larger than the diameter of each pin terminal 8. Thus, the pin terminal 8 can be inserted into the movable housing 4 without applying an insertion force. This makes it easier to connect the pin terminals 8 to respective circuit-board connection terminals 6. When the movable connector 1 is configured to have the LIF structure, the gap between a pair of free-state inner contact points 6*j*1 is made slightly smaller than the diameter of each pin terminal 8. Thus, an insertion force is required for the pin terminal 8 to push open the pair of the inner contact portions 6*j*1. Due to this insertion force, a user who performs connection can feel that the pin terminals 8 reach respective inner contact points 6*j*1. This enables the user to carefully continue the connection of the pin terminals 8 to the circuit-board connection terminals 6 by controlling strength. The movable connector 1 according to the present embodiment is an example that uses the LIF structure. The ZIF structure or the LIF structure can prevent the insertion force applied to the pin terminals 8 from affecting the soldering sections that fix the movable connector 1 to the circuit board P, more specifically, the soldering section for the fixation metal fitting 3*g* (not illustrated) and the soldering section P1 of the circuit-board connection portion 6*a* of each circuit-board connection terminal 6. This can suppress occurrence of defects, such as crack generation in the soldering section or the movable connector 1 coming off the circuit board P.

Next, the manipulation housing 5 is pressed down into the internal space 3*c* of the fixed housing 3 by pressing the top wall 5*a*4 of the manipulation housing 5 that protrudes upward from the top wall 3*b* of the fixed housing 3. Consequently, in terms of the relationship between the manipulation housing 5 and the movable housing 4, the locking arms 5*c* of the manipulation housing 5 pass over respective first stopper steps 4*e*1 of the movable housing 4 and further pass over the second stopper steps 4*e*2, which results in the complete engagement between the manipulation housing 5 and the movable housing 4.

On the other hand, in terms of the relationship between each contact reinforcing member 7 and the corresponding circuit-board connection terminal 6, a pair of the contact guide projections 7*c* of the contact reinforcing member 7 first come into contact with corresponding contact portions 6*j*. Here, the contact guide projections 7*c*, which are formed so as to have tapered faces that open outward, can guide the corresponding contact portions 6*j* therein.

When the contact portions 6*j* are guided into the space between the contact guide projections 7*c*, a pair of the second side walls 7*b*2 press the outer contact points 6*j*2 against each pin terminal 8. In other words, the front one of the second side walls 7*b*2 in the Y direction functions as a "first pressing portion" that presses the front one of the outer contact points 6*j*2 (i.e., one of the contact portions) in the Y direction. In addition, the rear one of the second side walls 7*b*2 in the Y direction functions as a "second pressing portion" that presses the rear one of the outer contact points 6*j*2 (i.e., the other one of the contact portions) in the Y direction. The distance between the second side walls 7*b*2 is shorter than the distance between the outer contact points 6*j*2. Accordingly, when a pair of the contact portions 6*j* enter the space between the second side walls 7*b*2, the outer contact points 6*j*2 press corresponding inner contact points 6*j*1 against each pin terminal 8. More specifically, the spring portions 6*j*3 press the inner contact points 6*j*1 against each pin terminal 8 by utilizing reaction forces generated due to the outer contact points 6*j*2 pressing the contact reinforcing member 7. Thus, the contact pressure exerted by the inner contact points 6*j*1 can be increased. A highly reliable electrical connection can be thereby obtained.

Because of a high contact pressure, the inner contact points 6*j*1 can be formed so as to maintain the contact positions with respect to the pin terminals 8 even if the movable housing 4 or the pin terminals 8 are displaced due to vibrations or the like. This can prevent fretting wear of the inner contact points 6*j*1 against the pin terminals 8 and can suppress the deterioration of the connection reliability caused by the fretting wear. The contact pressure of the inner contact points 6*j*1 can be increased by pressing down the manipulation housing 5 after the pin terminals 8 come into electrical contact with the inner contact points 6*j*1. Pressing down the manipulation housing 5 can reinforce the contact pressure easily.

As the manipulation housing 5 is pressed against the movable housing 4, the locking projections 5*d* of the locking arms 5*c* pass over respective first stopper steps 4*e*1 and second stopper steps 4*e*2. Every time the locking projections 5*d* pass these stopper steps, the locking arms 5*c* are relieved from bending and thereby generate vibrations. A user can feel multi-time click feelings (i.e. lower resistances to the pressing down) by hand and thereby recognize that the movable connector 1 has entered the complete engagement state. This can suppress the likelihood of incomplete engagement due to the user unintendedly abandoning the pressing operation in the middle of engagement. The user can also hear a click every time the locking arms 5*c* hit the bottoms of the recesses 4*e*. The occurrence of the incomplete engagement can be reliably suppressed by feeling the vibrations and hearing the clicks.

In the pressing operation of the manipulation housing 5 as described above, it is ideal to push the manipulation housing 5 straight toward the circuit board P. However, the movable connector 1 is small, and the pressed surface or the area of the top wall 5*a*4 to be pressed is also small. This makes it difficult for a user to press the center of the top wall 5*a*4. The user tends to push the top wall 5*a*4 at a point off the center and push it obliquely. However, even if an insertion force acts so as to tilt the manipulation housing 5 and the movable housing 4, the support spring portions 6*k* of the circuit-board connection terminals 6 deform elastically and flexibly. Accordingly, while allowing the displacement of the tilted manipulation housing 5 and movable housing 4, the movable connector 1 can engage and be electrically connected to the pin terminals 8.

The support spring portion 6*k* is different from a known spring portion. The support spring portion 6*k* extends so as to form a chevron shape (an inverse U-shape) inside the support spring accommodation region 3*c*1 that is formed by partitioning the internal space 3*c* of the fixed housing 3. Accordingly, the support spring portion 6*k* has a simple shape with a large spring length. Thus, the support spring portion 6*k* can perform a floating function in which the movable housing 4 and the manipulation housing 5 are supported flexibly.

Here, assume that stopper projections 7*b* of the contact reinforcing members 7 are press-fit into respective retaining grooves 5*b* of the manipulation housing 5, for example. In this case, unless the stopper projections 7*b* are press-fit into the retaining grooves 5*b* at exact positions, the central axis of each contact reinforcing member 7 may deviate from the center between a pair of the contact portions 6*j* of the corresponding circuit-board connection terminal 6. As a result, for example, one of the contact portions 6*j* (the first contact portion 6*j*A or the second contact portion 6*j*B) of the circuit-board connection terminal 6 and the corresponding elastic arm 6*i* are subjected to a large load, which may cause the elastic arm 6*i* to weaken and may impair connection reliability. However, the contact reinforcing member 7 is not fixed to but is movably held by the manipulation housing 5. Accordingly, a pair of the contact portions 6*j* of each circuit-board connection terminal 6 are in press-contact with the corresponding contact reinforcing member 7, which causes the pair of the contact portions 6*j* to position such that the central axis of the contact reinforcing member 7 is aligned with the center between the pair of the contact portions 6*j*.

Modification Examples

In the above embodiment, the "contact reinforcing portion" is exemplified as the contact reinforcing member 7 that is made of a metal piece. However, the contact reinforcing portion may be made of a resin (a resin molding). The "contact reinforcing portion" made of a resin may be formed as part of the manipulation housing 5 or may be molded into a body separate from the manipulation housing 5 and assembled into the manipulation housing 5 thereafter. The "contact reinforcing portion" formed in such a manner can reduce the production cost. On the other hand, in the case of the contact reinforcing member 7 being formed of a metal piece, a rigid metal piece may be used. This enables the contact portions 6*j* of the circuit-board connection terminal 6 to further increase the contact pressure. Here, in the case of the contact reinforcing member 7 being formed, for example, of a resin molding, when the contact portions 6*j* of the circuit-board connection terminal 6 are heated due to electrical conduction and come into press-contact with the contact reinforcing member 7 at a high contact pressure, the contact reinforcing member 7 softened by the heat may not sustain the contact pressure. However, the contact reinforcing member 7 made of a metal piece does not produce such a problem.

In the above embodiment, it is described by way of example that a pair of the contact portions 6*j* has the ZIF structure or the LIF structure. However, instead of having a structure that can decrease the insertion force, the movable connector 1 may be configured such that the inner contact points 6*j*1 produce an appropriate contact pressure required for a reliable electrical connection when the pin terminal 8 is inserted therein. The contact reinforcing member 7 may be used to further increase the contact pressure and to provide a function for use in strong-vibration environment.

In the above embodiment, the "pressing operation" of the manipulation housing 5 is described as an operation of moving the manipulation housing 5 relative to the movable housing 4. However, a "withdrawing operation" of the manipulation housing 5, by which the manipulation housing 5 is pulled up relative to the movable housing 4, may be adopted as the operation of moving the manipulation housing 5. For this purpose, each contact reinforcing member may be disposed, for example, under the outer contact points 6*j*2. By pulling up the manipulation housing, the outer contact points 6*j*2 may enter the inside the contact reinforcing member that moves upward.

In the above embodiment, it is described by way of example that each recess 4*e* includes the first stopper step 4*e*1 and the second stopper step 4*e*2. However, only one of the stopper steps may be formed if the effect of the multiple clicks is omitted. Alternatively, three stopper steps or more may be provided.

In the above embodiment, it is described by way of example that the engagement guides 5*e* are formed in the manipulation housing 5 and the temporary engagement projections 4*i* are formed in the movable housing 4. However, the temporary engagement projections may be formed in the manipulation housing 5, and the engagement guides may be formed in the movable housing 4.

What is claimed is:

1. A movable connector, comprising:
- a fixed housing to be fixed to a circuit board;
- a movable housing into which a connection object is inserted;
- a circuit-board connection terminal having
  - a circuit-board connection portion to be electrically connected to the circuit board,
  - a support spring portion that displaceably supports the movable housing relative to the fixed housing, and
  - a contact portion that comes into electrical contact with the connection object; and
- a manipulation housing to be coupled to the movable housing by an operation of moving the manipulation housing relative to the movable housing, the manipulation housing having a contact reinforcing portion that presses the contact portion against the connection object as a result of the operation of moving the manipulation housing.

2. The movable connector according to claim 1, wherein
- the circuit-board connection terminal has a pair of the contact portions,
- the pair of the contact portions are disposed so as to pinch the connection object, and
- the contact reinforcing portion has a first pressing portion that presses one of the contact portions and a second pressing portion that presses the other one of the contact portions.

3. The movable connector according to claim 1, wherein the contact portion has
- a first contact point that comes into press-contact with the connection object,
- a second contact point with which the contact reinforcing portion comes into press-contact, and
- a spring portion that links the first contact point and the second contact point and that urges the first contact point against the connection object by using a reaction force generated due to the second contact point coming into press-contact with the contact reinforcing portion.

4. The movable connector according to claim 1, wherein
- the contact reinforcing portion has a projection,
- the manipulation housing has a retaining groove that movably holds the projection via a gap provided between the retaining groove and the projection, and
- the gap enables the contact reinforcing portion to move relative to the manipulation housing.

* * * * *